US006578720B1

(12) United States Patent
Wang

(10) Patent No.: US 6,578,720 B1
(45) Date of Patent: Jun. 17, 2003

(54) RACK COMPRISING ADJUSTABLE SLIDE RAILS

(75) Inventor: Yung-Chang Wang, Chang Hua Hsien (TW)

(73) Assignee: I Jang Industrial Co., Ltd., Chang Hua Hsien (TW)

( * ) Notice: Subject to any disclaimer, the term of this patent is extended or adjusted under 35 U.S.C. 154(b) by 0 days.

(21) Appl. No.: 10/068,383

(22) Filed: Feb. 8, 2002

(51) Int. Cl.[7] ..... A47F 3/14

(52) U.S. Cl. ..... 211/126.15; 211/90.04; 211/186; 211/181.1

(58) Field of Search ..... 211/46, 88.02, 211/105.5, 105.6, 105.3, 105.1, 133.2, 151, 187, 186, 181.1, 94.02, 106, 90.04, 90.03, 88.01, 175, 90.02, 126.15, 119.009, 170–173, 204; 312/184, 205, 265.1, 265.2, 408, 410; 248/242, 243

(56) References Cited

U.S. PATENT DOCUMENTS 2,103,885 A * 12/1937 Whalen ..... 312/404
2,323,448 A * 7/1943 Brennan ..... 211/46
3,221,677 A * 12/1965 Kerr ..... 108/102
4,597,616 A * 7/1986 Trubiano ..... 312/246
4,795,041 A * 1/1989 Remmers ..... 211/126.15
4,836,389 A * 6/1989 Poulton ..... 211/45
4,901,871 A * 2/1990 Ohm et al. ..... 211/119.004
5,083,848 A * 1/1992 Merino et al. ..... 312/332.42
5,205,630 A * 4/1993 Welch et al. ..... 312/249.11
5,396,995 A * 3/1995 Turek ..... 211/46
5,405,020 A * 4/1995 Fotioo ..... 211/46
5,415,299 A * 5/1995 Usner ..... 211/105.1
5,515,980 A * 5/1996 Fotioo ..... 211/46
5,531,464 A * 7/1996 Maurer et al. ..... 280/47.35
5,713,502 A * 2/1998 Dixon ..... 224/542
5,810,179 A * 9/1998 Kleiman ..... 211/88.01
5,906,277 A * 5/1999 Vienneau ..... 206/315.1
6,021,908 A * 2/2000 Mathews ..... 211/90.02
6,148,813 A * 11/2000 Barnes et al. ..... 126/339

* cited by examiner

*Primary Examiner*—Bruce A. Lev
*Assistant Examiner*—Jennifer E. Novosad
(74) *Attorney, Agent, or Firm*—Harrison & Egbert

(57) ABSTRACT

A rack includes a plurality of upright support rods, horizontal support rods fastened between the upright support rods, slide rails fastened between the horizontal support rods, and shelves slidably mounted on the slide rails. The slide rails are adjustable in length and formed of a main body, a movable member, and an elastic element. The main body has a hollow end. The movable member has a hollow interior with an open end and a closed end. The movable member is movably fitted over the hollow end of the main body. The elastic element is located in the hollow interior of the movable member and the hollow end of the main body such that one end of the elastic element is retained by the closed end of the movable member, and such that the other end of the elastic element is retained in the hollow end of the main body.

1 Claim, 5 Drawing Sheets

RACK COMPRISING ADJUSTABLE SLIDE RAILS

BACKGROUND OF THE INVENTION

1. Field of the Invention

The present invention relates generally to a rack, and more particularly to a rack which has a plurality of slidable shelves capable of being drawn out and then pushed back into place.

2. Description of Related Art

Certain conventional racks have slidable shelves capable of being drawn out and then pushed back into place. Such conventional racks are generally defective in design because the component parts of the racks cannot be easily assembled, and because the slidable shelves are apt to fall from the rack frame at such time when the slidable shelves are drawn out.

BRIEF SUMMARY OF THE INVENTION

The primary objective of the present invention is to provide a rack which is free of the drawbacks of the conventional racks described above.

In keeping with the principle of the present invention, the foregoing objective of the present invention is achieved by a rack comprising a support frame, a plurality of slide rails, and a plurality of slidable shelves. The slide rails are formed of a main body, a movable member, and an elastic element disposed between the main body and the movable member.

The features, fuctions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
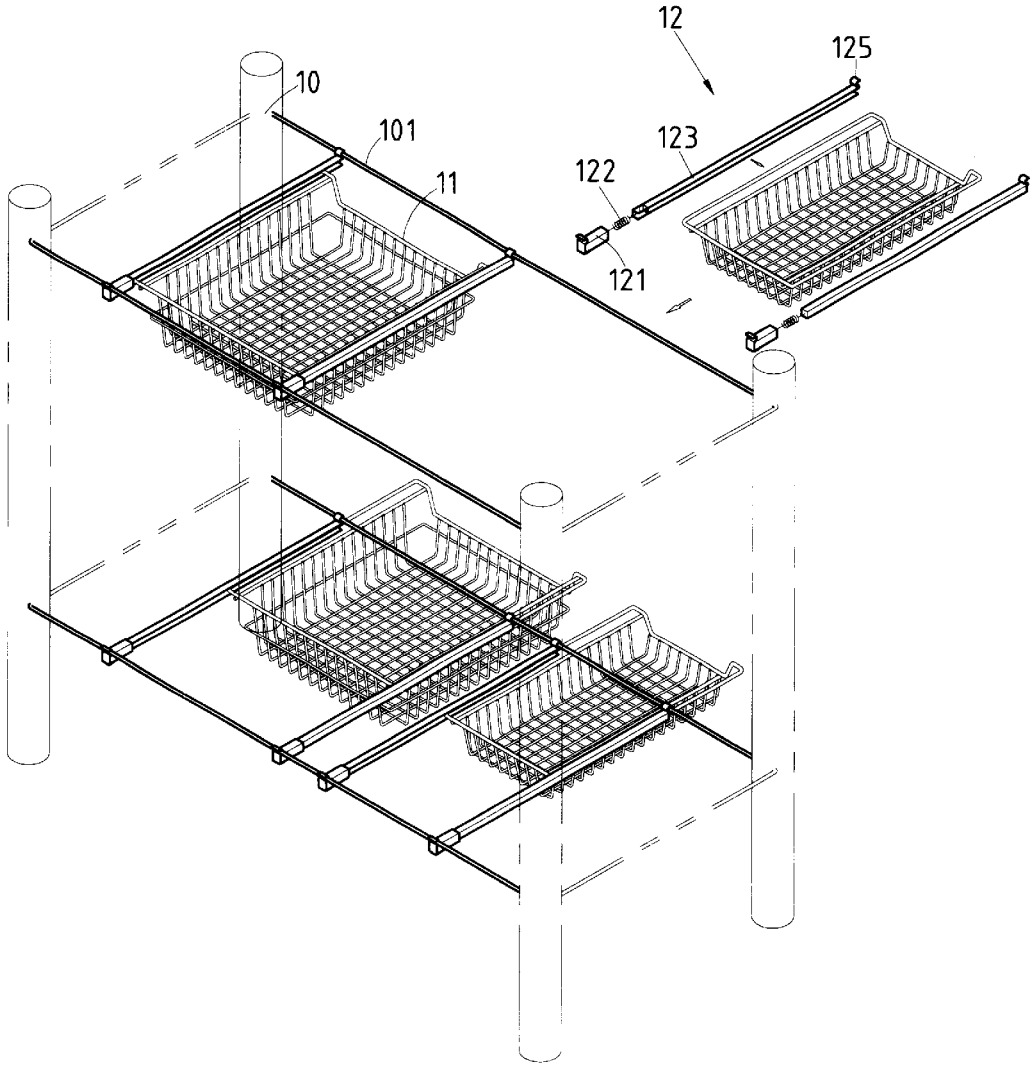
FIG. 1 shows a schematic perspective view of the preferred embodiment of the present invention.
Figure 2:
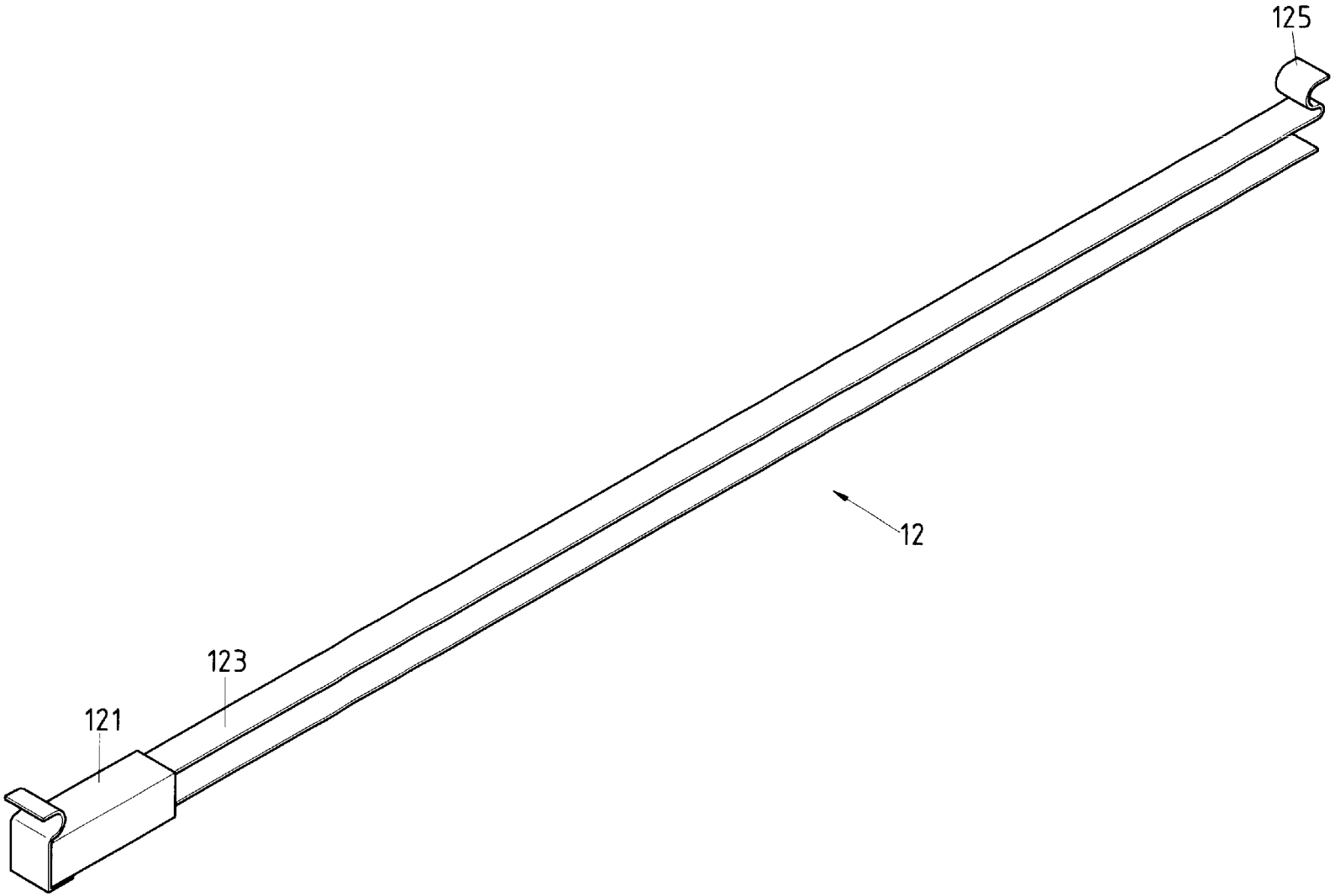
FIG. 2 shows a perspective view of a slide rail of the preferred embodiment of the present invention.
Figure 3:
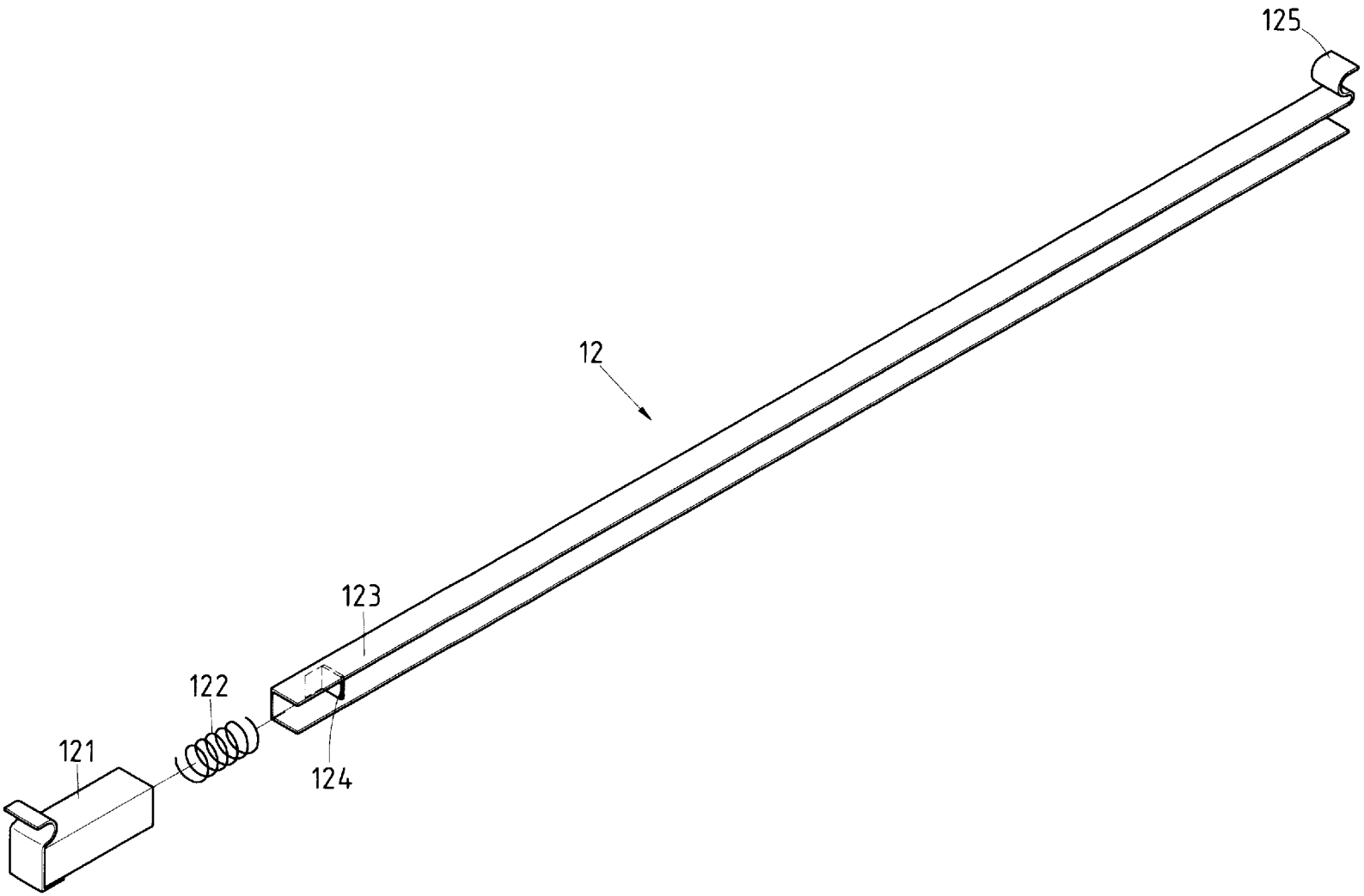
FIG. 3 shows an exploded view of the slide rail of the preferred embodiment of the present invention.
Figure 4:
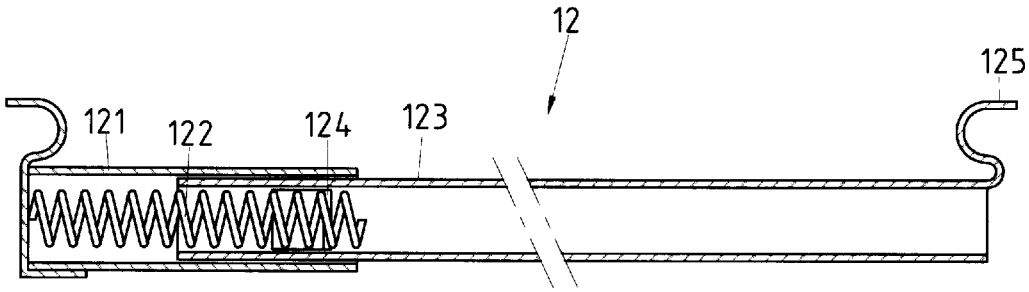
FIG. 4 shows a schematic sectional view of the slide rail of the preferred embodiment of the present invention at work.
Figure 5:
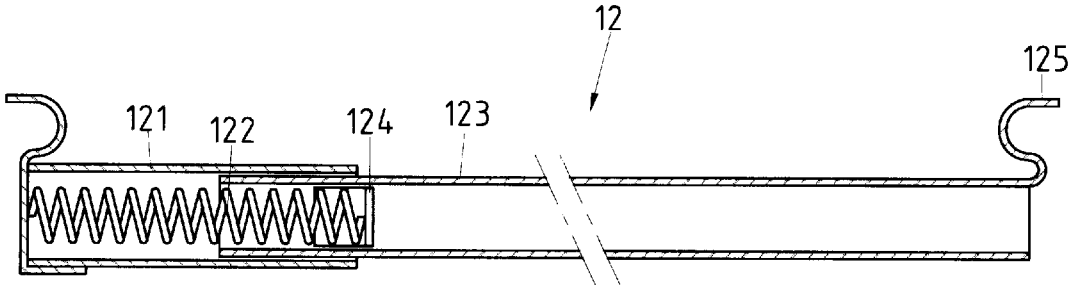
FIG. 5 shows another schematic sectional view of the slide rail of the preferred embodiment of the present invention at work.
Figure 6:
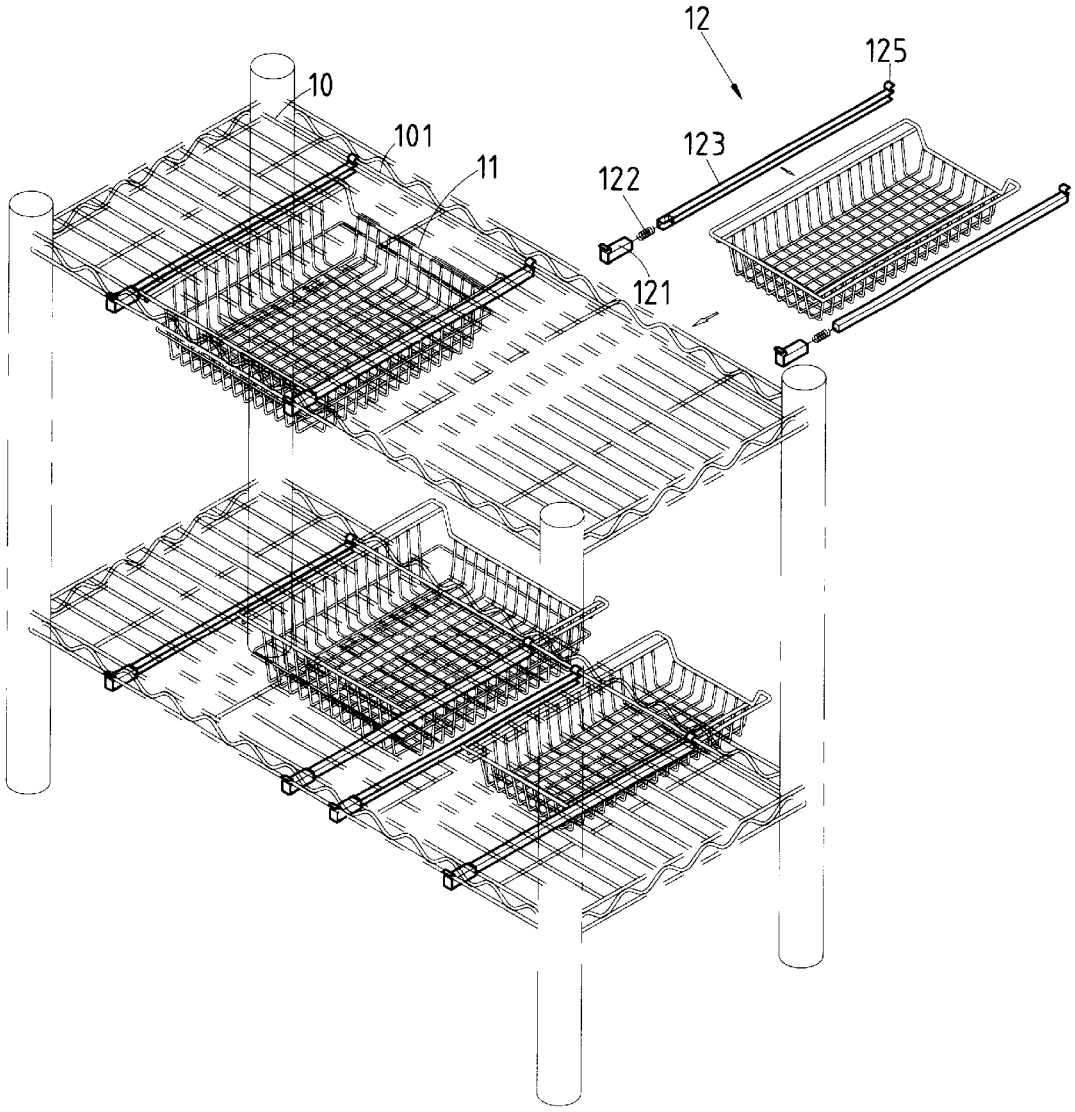
FIG. 6 shows another schematic perspective view of the preferred embodiment of the present invention.

As shown in FIGS. 1–6, a rack embodied in the present invention comprises a support frame, a plurality of slidable shelves 11, and a plurality of slide rails 12. The, support frame is formed of four upright support rods 10 and a plurality of horizontal support rods 101 fastened between the upright support rods 10. The slide rails 12 are retained by the horizontal support rods 101. Each of the shelves 11 is slidably retained by two slide rails 12. The shelves 11 can be drawn out and then pushed back into place.

The present invention is characterized by the slide rails 12 which are formed of a movable member 121, a spring 122, and a main body 123.

The movable member 121 is fitted at an open end thereof over one end of the main body 123 in conjunction with the spring 122 which is fitted into the movable member 121 and the one end of the main body 123 such that one end of the spring 122 is retained by a closed end of the movable member 121, and such that the end of the spring 122 is retained by a retaining piece 124 located in the one end of the main body 123. The main body 123 is provided at the other end with a retaining hook 125.

Each slide rail 12 is held between the two horizontal rods 101 such that the closed end of the movable member 121 is held by one horizontal rod 101, and that the retaining hook 125 of the other end of the main body 123 is retained by other horizontal rod 101. Each shelf 11 is slidably held between two slide rails 12.

In view of the fact that each slide rail 12 is provided with the spring 122 which is located between the movable member 121 and the main body 123, the slide rail 12 is adjustable in length, thanks to the elasticity of the spring 122. For this reason, the slide rails 12 of the present invention fit the support frames of various sizes.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A rack comprising:

four upright support rods;

a plurality of horizontal support rods each being fastened to and extending between a respective pair of said four upright support rods;

a plurality of slide rails each being supported by and extending between a respective pair of said plurality of horizontal support rods; and a plurality of shelves each being slidably supported by a respective pair of said plurality of slide rails, each of said plurality of slide rails being of an adjustable length, each of said plurality of slide rails comprising:

a main body having a hollow interior at one end thereof, said hollow interior having a retaining piece therein, said main body having a fastening means at an opposite end thereof, said fastening means for fastening said main body to one of said plurality of horizontal support rods;

a movable member having a hollow interior and an open end, said one end of said main body extending through said open end and into said hollow interior of said movable member, said movable member having a closed end opposite said open end, said closed end having a fastening means thereon for fastening said movable member to another of said plurality of horizontal support rods; and an elastic element positioned in said hollow interior of said main body such that one end of said elastic element is retained by said retaining piece, said elastic element extending into said hollow interior of said movable member such that an opposite end of said elastic element is retained by said closed end of said movable member.

* * * * *